United States Patent [19]

Petre et al.

[11] 4,195,208

[45] Mar. 25, 1980

[54] SINGLE POLE DOUBLE THROW SNAP SWITCH

[75] Inventors: Mark L. Petre; Ellis P. Lipp, both of Frankfort, Ind.

[73] Assignee: Emhart Industries, Inc., Indianapolis, Ind.

[21] Appl. No.: 926,438

[22] Filed: Jul. 20, 1978

[51] Int. Cl.[2] ..... H01H 19/32

[52] U.S. Cl. ..... 200/63 R; 200/155 R; 200/292

[58] Field of Search ..... 200/63 R, 63 A, 155 R, 200/292, 67 R

[56] References Cited

FOREIGN PATENT DOCUMENTS 644848 5/1937 Fed. Rep. of Germany ..... 200/63 R

*Primary Examiner*—Houston S. Bell, Jr.

*Attorney, Agent, or Firm*—Hoffmann & Meyer

[57] ABSTRACT

A pair of electrical terminals are held in close spaced relation to each other to provide a gap therebetween. A third electrical terminal extends into the gap. A spring contact arm engages the third electrical terminal and pivots between it and the other two electrical terminals.

6 Claims, 3 Drawing Figures

SINGLE POLE DOUBLE THROW SNAP SWITCH

BACKGROUND OF THE INVENTION

Generally speaking, the present invention is directed to a single pole, double throw snap switch which comprises, a terminal board having an aperture substantially at its center portion; a pair of electrical terminals carried by the terminal board closely spaced from one another providing a gap therebetween; a third electrical terminal carried by the terminal board and extending into the gap; a spring contact arm having opposed ends, one of the ends pivotly carried in a slot provided in a wall of the aperture, the other end extending into the gap and engaging the third terminal; a shaft extending into the aperture and a rotor carried by the shaft to be rotatable therewith; and actuator means carried by the rotor engaging the spring contact arm to move same between the first and third and between the second and third electrical terminals.

The present invention relates to electric switches and more particularly relates to snap switches including those of the type mounted on the back of volume controls and which are designed to switch fairly heavy currents used in radio and television circuits and sets.

By the very nature of their use, the size of these switches is important as relatively small dimensions are characteristic of the specifications and dimensions set forth in these circuits. However the small diameter, shallow depth housing leads to difficulty in obtaining the requisite spring action or movement range for efficient make-and-break contact. It is also difficult to obtain prolonged life between the contacts by providing an efficient, self-cleaning and non-arcing means within the switch.

In U.S. Pat. No. 3,324,261 issued June 6, 1967 there is described a snap switch which provides a simple, economical and efficient snap switch wherein all of the aforementioned desirable features are obtained at a minimum of material and labor cost, and wherein a small, compact, highly efficient structure is obtained having optimum calibration and alignment techniques, lack of depth, good wipe characteristics of the contacts and no current carried through the flexing portions of the contact spring except at the moment of switching.

The present invention represents an improvement over the switch described in U.S. Pat. No. 3,324,261 primarily in that such switch is limited to a single pole single throw switch.

OBJECTS OR FEATURES OF THE INVENTION

It is, therefore, a feature of the invention to provide a snap switch which is an improvement over the switch described in U.S. Pat. No. 3,324,261. Another feature of the invention is to provide a single pole double throw snap switch. Another feature of the invention is to provide such a switch wherein there is a pair of electrical terminals carried by a terminal board in close relation to provide a gap between the two and a third electrical terminal carried by the terminal board and extending into the gap. Still another feature of the invention is the provision of such a switch wherein a spring contact blade is pivotly carried by the terminal board and extends into the gap and engages the third electrical terminal. Yet another feature of the invention is the provision of such a switch wherein a switch actuator is carried on a rotor and engages the spring contact blade to pivot it between the electrical terminals. These and other features of the invention will become apparent from the following description taken in conjunction with the accompanying drawings.

DESCRIPTION OF A PREFERRED EMBODIMENT OF THE INVENTION

Figure 1:
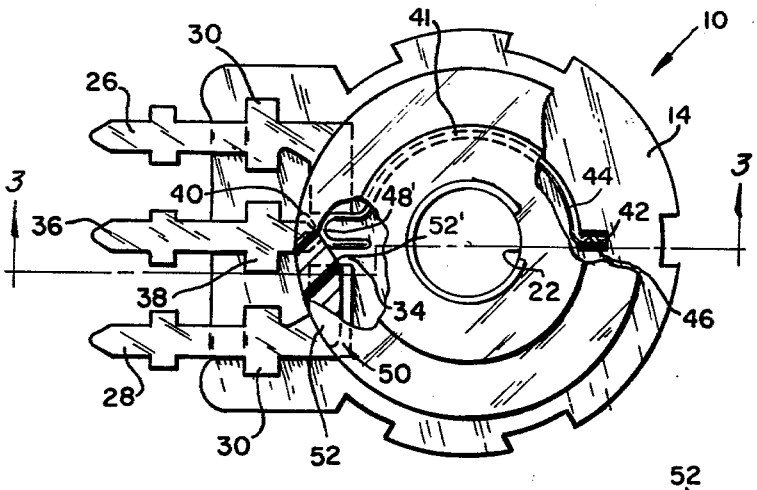
FIGS. 1 and 2 are top views of the snap switch of the invention showing two operating positions, with portions of the switch removed for clarity.

Referring now to the drawings there is shown a snap switch 10 embodying the principles of the invention. In general switch 10 is of a single pole double throw type. It includes a cup-shaped housing 12 having an open end which is closed by a terminal board 14, the housing being clamped to the terminal board through a plurality of ears 16 which engage and bend over indents 18 of the terminal board. A shaft 20 extends through a centrally disposed aperture 22 in the terminal and is rotatable therein. The shaft carries a rotor 24 which rotates in accordance with the shaft.

A pair of L-shaped electrical terminals 26 and 28 are carried by the terminal board by ears 30 which extend through apertures of the terminal board and are then bent over. The terminals are spaced closely together to form a gap 34 therebetween. A third electrical terminal 36 is also carried by the terminal board through a similar arrangement of ears 38 engaging similar apertures 32 in the terminal board. Electrical terminal 36 extends into gap 34 at an end which has a triangular configuration 40.

A C-shaped spring blade 41 is pivotly carried in a slot 42 cut in a wall 44 of aperture 22 of the terminal board. As shown, the blade is pivotly carried in the slot by a substantially straight extension 46 of the blade. At the opposed, distal end of the blade, there is a U-shaped portion 48 which extends into gap 34 and engages the end 40 of the third electrical terminal.

A switch blade actuator means 50 in the form of a triangular boss 52 is carried by rotor 24 and engages the bent portion 48' of the U-shaped portion 48 of the spring contact blade at the sides of the triangular shape.

Figure 2:
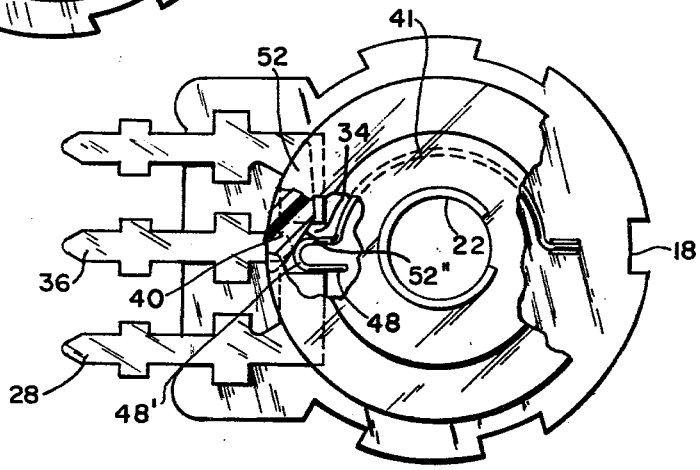
Figure 3:
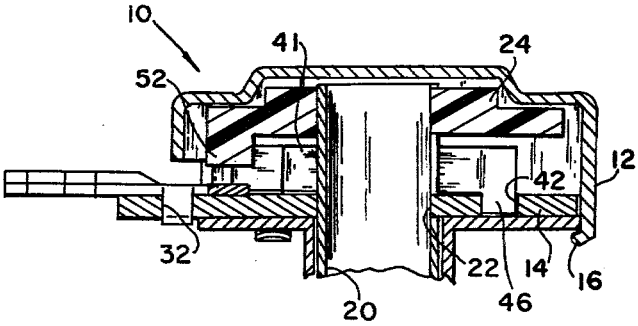
FIG. 3 is a view taken along the line 3—3 of FIG. 1.

In operation, referring to FIG. 1, the switch is shown with spring contact blade 41 bridging electrical terminals 26 and 36. Shaft 20 is manually rotated causing boss 40 to push the contact blade 41 away from terminal 36. This movement continues until the U-shaped portion 48 clears side 52' of the triangular boss at which time the spring will snap over to the position shown in FIG. 2. In FIG. 2 the spring contact blade bridges electrical terminals 28 and 36 with the side 52'' of the boss engaging the U-shaped portion 48 of the spring contact blade. To return the contact spring to the position of FIG. 1, the action is reversed.

Another feature of the invention and representing an improvement over the switch of the above—not U.S. Pat. No. 3,324,261 lies in the use of the C-shaped spring blade. The C-shaped spring blade permits the use of a shaft that extends through the switch in contrast to the switch of U.S. Pat. No. 3,324,261 wherein the S-shaped spring blade prevents such an arrangement. Since the shaft 20 can extend through the switch, gang switching can be provided.

What is claimed is:

1. A single pole, double throw snap switch comprising:

(a) a terminal board having an aperture substantially at its center portion, (b) a pair of electrical terminals carried by said terminal board closely spaced from one another providing a gap therebetween, (c) a third electrical terminal carried by said terminal board and extending into said gap, (d) a spring contact blade having opposed ends, one of said ends pivotly carried in a slot provided in a wall of said aperture, the other end extending into said gap and engaging said third terminal, (e) a shaft extending into said aperture and a rotor carried by said shaft to be rotatable therewith, and (f) actuator means carried by said rotor engaging said spring contact blade to move said spring blade between said first and third and between said second and third electrical terminals.

2. A single pole double throw snap switch according to claim 1 wherein said spring contact blade is C-shaped and said end extending into said gap has a U-shape.

3. A single pole double throw snap switch according to claim 2 wherein said spring contact blade has a substantially straight extension carried on said end carried in said slot.

4. A single pole double throw snap switch according to claim 1 wherein said actuator means includes a boss carried by said rotor.

5. A single pole double throw snap switch according to claim 4 wherein said boss is triangular shaped with the sides thereof engaging said end of said contact spring arm.

6. A single pole double throw snap switch according to claim 1 further including a cup shaped cover having an open end substantially enclosing said switch, said terminal board closing same.

* * * * *